US006558268B2

(12) United States Patent
Tindale

(10) Patent No.: US 6,558,268 B2
(45) Date of Patent: May 6, 2003

(54) GOLF PUTTER WITH ADJUSTABLE SIGHT LINE

(76) Inventor: John C. Tindale, 1400 E. Ave., Unit 513, Rochester, NY (US) 14610

( * ) Notice: Subject to any disclaimer, the term of this patent is extended or adjusted under 35 U.S.C. 154(b) by 0 days.

(21) Appl. No.: 09/951,722

(22) Filed: Sep. 14, 2001

(65) Prior Publication Data

US 2003/0054900 A1 Mar. 20, 2003

(51) Int. Cl.[7] ..... A63B 69/36

(52) U.S. Cl. ..... 473/244; 473/251; 473/252

(58) Field of Search ..... 473/231, 219, 473/223, 226, 227, 238, 241, 242, 244, 251, 252, 253, 254, 220; D21/742, 743, 744, 745, 746

(56) References Cited

U.S. PATENT DOCUMENTS

| | | | | |
|---|---|---|---|---|
| 3,292,928 | A | * | 12/1966 | Billen |
| 3,529,830 | A | * | 9/1970 | Palotsee |
| 3,667,761 | A | * | 6/1972 | Palotsee |
| 3,680,860 | A | | 8/1972 | Elkins, Jr. |
| 3,880,430 | A | * | 4/1975 | McCabe |
| 3,909,004 | A | * | 9/1975 | Vella |
| 3,951,415 | A | | 4/1976 | Stuart |
| 4,043,562 | A | * | 8/1977 | Shillington |
| 4,128,244 | A | * | 12/1978 | Duclos |
| 4,135,720 | A | * | 1/1979 | Lancelloti |
| 4,174,839 | A | | 11/1979 | Marrs |
| 4,204,332 | A | | 5/1980 | Gray |
| D255,373 | S | | 6/1980 | Solheim |
| 4,291,883 | A | * | 9/1981 | Smart |
| 4,462,595 | A | | 7/1984 | Hodson |
| 4,527,799 | A | | 7/1985 | Solheim |
| 4,629,193 | A | | 12/1986 | Pierman |
| 4,647,045 | A | * | 3/1987 | Bilyeu |
| 4,986,544 | A | * | 1/1991 | Benson |
| 5,029,868 | A | | 7/1991 | Cloud |
| D325,950 | S | * | 5/1992 | Duran |
| 5,160,142 | A | * | 11/1992 | Marshall |
| 5,169,150 | A | | 12/1992 | Tindale |
| 5,244,205 | A | | 9/1993 | Melanson et al. |
| 5,417,429 | A | * | 5/1995 | Strand |
| 5,429,366 | A | * | 7/1995 | McCabe |
| 5,447,313 | A | * | 9/1995 | Finley |
| 5,538,249 | A | * | 7/1996 | Benson |
| 5,577,726 | A | | 11/1996 | Fenton |
| 5,803,824 | A | | 9/1998 | Rollingson |
| 5,816,931 | A | | 10/1998 | Schooler |
| 6,001,024 | A | | 12/1999 | Van Alen, II et al. |
| 6,062,986 | A | * | 5/2000 | Kaise |
| 6,095,929 | A | | 8/2000 | Clark |
| 6,126,555 | A1 | | 10/2002 | Schooler |

* cited by examiner

*Primary Examiner*—Sebastiano Passaniti
(74) *Attorney, Agent, or Firm*—Shlesinger, Fitzsimmons & Shlesinger

(57) ABSTRACT

A putter head is provided with a plane, flat golf ball engaging surface which extends between opposite ends of the putter head. Mounted in a recess formed in the putter head rearwardly of its face is an adjustable sighting line support having in its upper surface an elongage sighting line which registers at one end with the face of the head, and extends rearwardly therefrom. The support is mounted for limited adjustment about an axis that extends parallel to and is spaced rearwardly of the face of the putter head. In one adjusted position the sighting line extends at right angles rearwardly from the putter face in a manner similar to conventional putter sighting lines. However the support is mounted for limited rotational movement for up to at least 10° either clockwise or counterclockwise about its pivotal axis thereby to cause the sighting line to be secured in any one of a plurality of different angular positions other than 90° relative to the face of the putter head. The support is secured releasably in each of its adjusted positions by a screw which extends through the bottom of the putter head and threads into an internally threaded recess in the sighting line support.

11 Claims, 1 Drawing Sheet

GOLF PUTTER WITH ADJUSTABLE SIGHT LINE

BACKGROUND OF THE INVENTION

This invention relates to golf putters, and more particularly to an improved such putter which has mounted thereon a sight line which can be adjusted to compensate for any inherent misalignment of a player's putting/stroke. Even more particularly, this invention relates to an improved such putter which considerably reduces the time and cost of compensating for one's putting stroke misalignment.

For many years there have been developed a variety of systems and apparatus for detecting and correcting the misalignment of one's putting stroke. Once the misalignment has been detected, there are numerous devices for modifying a putter to compensate for the misalignment. U.S. Pat. No. 3,951,415, for example, discloses a putter sighting device which is adjustably clamped onto a shaft of a conventional putter to be observed by the player when he or she is putting. The U.S. Pat. No. 4,629,193 discloses a variety of rather complexedly shaped putters having formed therein sighting notches, and a specially shaped socket in which is secured at the lower end a conventional golf club shaft. The applicant herein has also developed putting stroke correcting apparatus, such as disclosed in U.S. Pat. No. 4,809,984 and U.S. Pat. No. 5,169,150. This last named apparatus detects a golfer's inherent misalignment of the face of a putter during a putting stroke, and solves the matter by forming on the head of the putter a corrective sighting line or notch that is inclined to the conventional sighting line which is usually formed on the head of the putter to extend normal to the face of the putter that is to be engaged with a golf ball.

The above-noted apparatus have proved to be extremely helpful in correcting a player's tendency to slightly misalign the face of the putter during a putting stroke. However, in prior such apparatus the solution has been to fix a corrective sighting line onto the top of the putter head for observance by the player. In many instances this amounts to a rather temporary solution, because while the corrective sighting line might serve the purpose for a reasonable period of time, it is not at all unusual for certain players once again to find that they are experiencing further misalignment of the putter face. This may well lead to further testing and subsequent additional marking of a new corrective sighting line on the putter.

Accordingly, it is an object of this invention to provide an improved putter, which will considerably minimize the time and expense involved in providing corrective sighting lines of the type noted above.

More specifically, it is an object of this invention to provide an improved putter, which has mounted thereon a single sighting line which can be readily adjusted to provide any one of a number of different sighting lines on the putter.

More specifically this invention relates to an improved such putter having a sighting line and support therefor which are mounted for limited adjustment in opposite directions about an axis extending in spaced, parallel relation to the putter face.

Other objects of the invention will be apparent hereinafter from the specification and from the recital of the appended claims, particularly when read in conjunction with the accompanying drawing.

SUMMARY OF THE INVENTION

A putter head has thereon a plane, flat front surface or face for engagement with a golf ball, and has therein rearwardly of the front surface a recess for accommodating an adjustable sighting line support. The support is adjustably secured in the recess for limited rotational adjustment about an axis spaced from and extending parallel to the face of the putter head. The support has on its upper surface a sighting line registering at one end with the head's face, and adjustable by the support to extend normal to the putter face, or into any one of a number of different positions in which the line is inclined at other than 90° to the face of the putter head.

THE DRAWING

DETAILED DESCRIPTION OF THE PREFERRED EMBODIMENT

Figure 3:
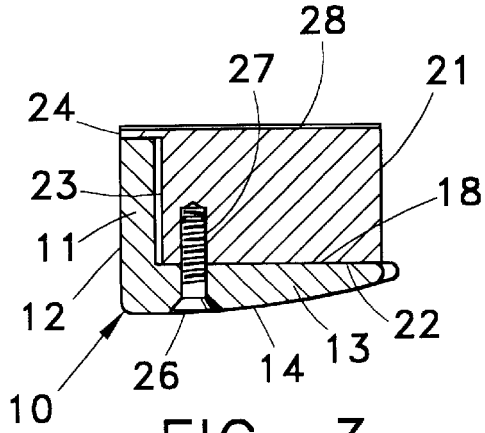
FIG. 3 is a sectional view taken along the line 3—3 in FIG. 2 looking in the direction of the arrows.
Figure 2:
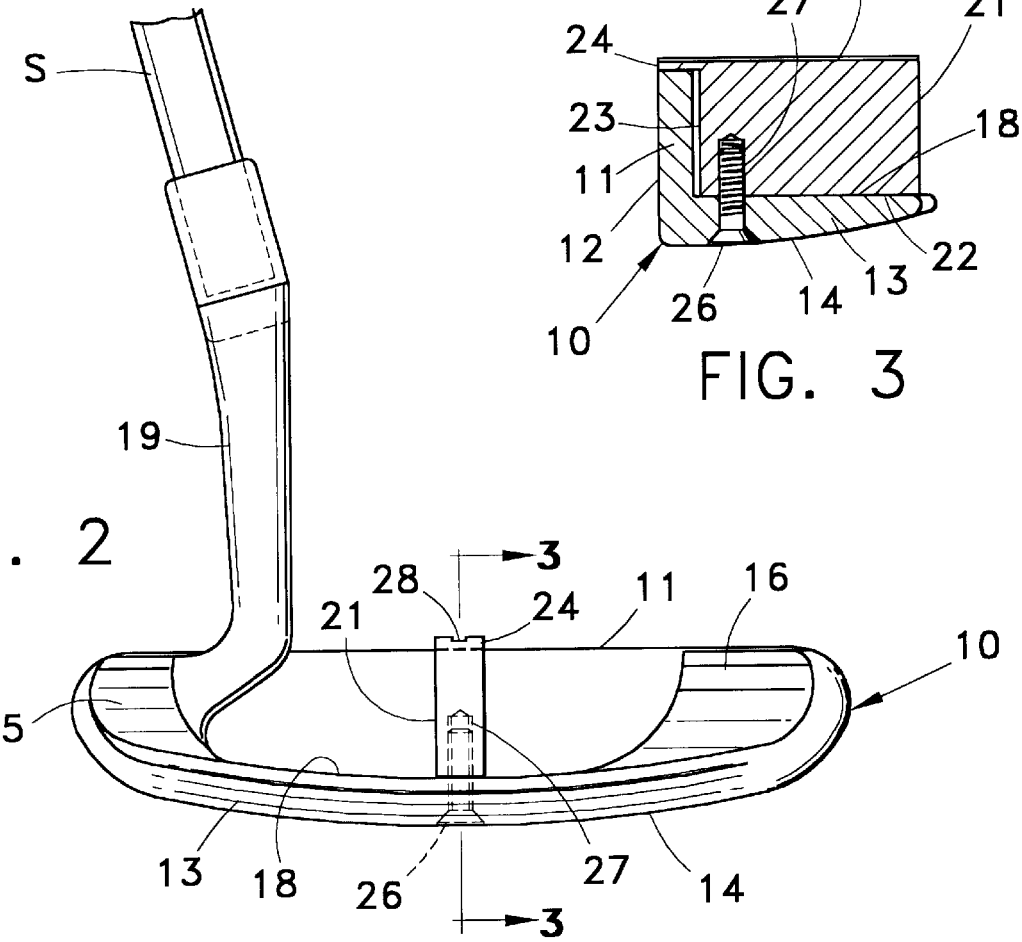
FIG. 2 is a rear elevational view of the putter head and associated shaft as seen when looking toward the lower side of the putter head as shown in FIG. 1.

Referring now to the drawing by numerals of reference, 10 denotes generally a golf club putter head having a front wall section 11 which is generally rectangular in cross section, as shown in FIG. 3, and which has thereon a plane, flat outer surface or face 12 engagable with a golf ball (not illustrated). Integral with and projecting from the rear face of the front wall section 11 adjacent the lower end thereof is a bottom wall section 13 having thereon a slightly curved or rounded bottom surface 14. Integral with and extending between the front and bottom wall sections 11 and 13 adjacent opposite ends thereof are two spaced, curved sections 15 and 16 of the head 10. Between the curved sections 15 and 16 the bottom wall section 13 has formed on its upper surface a nearly planar surface 18, which is located medially of opposite ends of the head 10, and which extends at right angles to the plane rear surface of the front wall section 11. Integral with the curved section 15 adjacent one end of the head 10, and projecting vertically upwardly therefrom is a rigid club shaft support 19 having in its upper end a circular socket disposed to have secured therein one end of a conventional golf club shaft S.

Instead of having a fixed sight line secured to the upper surface thereof to extend at right angles to the wall section 11, the head 10 of this invention is provided with an adjustable sight line. For example, numeral 21 denotes a rather small, rectangularly shaped sighting line support having a thickness approximately equal to that of the front wall section 11, a plane bottom surface 22 disposed in coplanar engagement with the upper surface 18 of the bottom wall section 13, and a planar front wall surface 23 (FIG. 3) disposed in spaced, parallel, confronting relation to the inside surface of the wall section 11. Support 21 projects slightly above the plane upper surface of the front wall section 11, and has thereon an integral, narrow lip section 24 which closely overlies the upper surface of the front wall section 11. The support 21 is adjustably secured on the surface 18 by a screw 26, the threaded shank of which extends through a registering opening in the bottom wall 13, and threads into an internally threaded blind bore 27 formed in the underside of support 21 adjacent its forward wall surface 23. To provide a sighting line for the putter head 10, as noted hereinafter, support 21 has in its upper surface a shallow, rectangularly shaped notch 28 disposed medially of, and parallel to opposite sides of support 21, and extending the full length of the upper surface of support 21, including its projecting lip portion 24.

Figure 1:
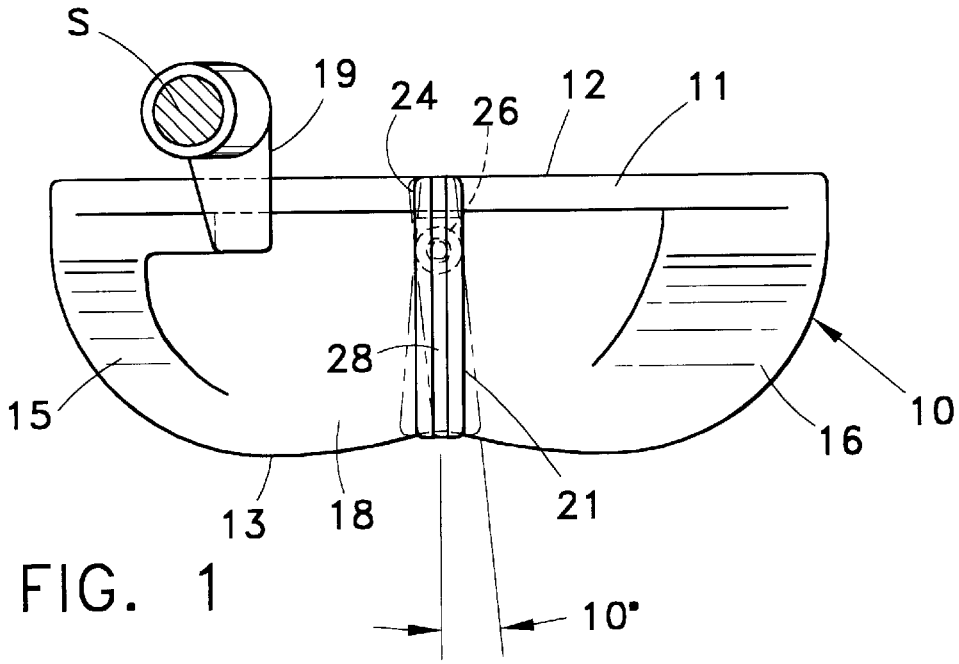
FIG. 1 is a plan view of an improved putter head made according to one embodiment of this invention, the associated club shaft being show in section where it is secured at one end thereof in a bracket that is integral with the putter head.

As illustrated in the drawing, support 21 has been positioned by the screw 26 in such manner that the elongate notch 28 in the upper surface of support 21 extends at right angles to the front wall section 11 substantially medially of opposite ends o the head 10. In this position the center of the notch 28 registers with a conventional sighting line (not illustrated) which is formed on the surface 18 beneath support 21 to extend at right angles to the front wall section 11. In such position, therefore, the notch 28, would, in essence, correspond to the conventional sighting line formed on head 10, as well as on most conventional putters. However, unlike conventional putter heads, when the screw 26 is loosened, the support 21 can be adjusted to swing notch 28 clockwise or counterclockwise about the axis of screw 26 for up to at least 10° in either direction from its solid line position shown in FIG. 1. Thus, the sighting line 28 can be adjusted, if necessary, into any one of a number of different angular positions relative to the putter face 12 in order to compensate for any inherent misalignment a respective player may have with respect to a conventional putter sighting line.

For example, as disclosed in U.S. Pat. No. 5,169,150, a golfer may first be checked by a putting stroke correcting device to determine if the player has in fact any such tendency to misalign the putter face when using a conventional putter sighting line. Once any such misalignment has been detected, the screw 26 on the putter shown on the drawing herein can be momentarily loosened to permit the support to be swung slightly angularly about the axis of screw 26 into any one of a number of different positions to compensate for the misalignment, after which the screw 26 would be tightened to secure support 21, and hence its sighting line notch 28 at an angle other than 90° to the front wall section 11.

The advantage of the above-described invention is that, after support 21 has been adjusted to compensate for any player's misalignment, the player need only observe the one sighting line 28, which in practice may be colored or darkened to be readily visible to the associated player. Also, in the event that the player's tendency to misalign the putter face 12 should, for some reason, change or vary after a period of time, the support 21 can again be adjusted depending upon the outcome of the further testing of the player's sighting ability by a device of the type shown, for example, in U.S. Pat. No. 5,169,150. The advantage also is the fact that the same putter head 10 can be utilized for compensating for any changes in misalignment instead of requiring a new putter head or new markings on a putter head.

While the invention has been illustrated and described in connection with only one embodiment thereof, it will be apparent that this application is intended to cover any such modifications that may fall within the scope of one skilled in the art. For example, while the support 21 has been described as being generally rectangular in cross section, it will be apparent, that, depending upon the overall shape of the basic putter head (wall sections 11 and 13 and the end sections 15 and 16) it will be apparent that the shape of the support 21 can be readily changed to enable it to be mounted on a differently shaped putter head providing its sighting notch or line 28 can be readily adjusted to be inclined slightly from an angle at which it extends at right angles to the putter face. It is intended, therefore, that this application cover any such modifications that may fall within the scope of one skilled in the art or the appended claims.

What is claimed is:

1. A putter head for a golf club, comprising a body section having an elongate, external, planar face extending along one side thereof, and having therein a recess positioned rearwardly of said face, a sighting line support having a lower end adjustably seated in said recess for limited rotational adjustment in opposite directions about an axis spaced from and extending parallel to said planar face, and an elongate sighting line formed on an upper surface of said support and extending transversely of said planar face, said support being adjustable to secure said sighting line selectively in a plurality of different angular positions with respect to said planar face, including a medial position in which said line extends at right angles to said planar face.

2. A putter head as defined in claim 1, wherein said axis intersects said sighting line intermediate the ends thereof and at right angles with respect thereto.

3. A putter head as defined in claim 2, wherein said sighting line comprises an elongate, shallow recess formed in said upper surface of said support.

4. A putter bead as defined in claim 1, wherein said support is adjustable for up to at least 10° either clockwise or counterclockwise about said axis from the position thereof when said sighting line extends at right angles to said planar face.

5. A putter head as defined in claim 1, wherein said body section has thereon at one side of said recess an internal planar surface facing on said recess and disposed in spaced, parallel relation to said external planar face, and said support has thereon a planar surface disposed in spaced, parallel relation to said internal planar surface when said sighting line is in said medial position.

6. A putter head as defined in claim 5, wherein the threaded shank of a screw extends through an opening formed in the bottom of said body section to open on the bottom of said recess, and said shank is threaded into an internally threaded blind bore formed in the bottom of said support whereby said support is adjustable about the axis of said screw to effect angular adjustment of said sighting line.

7. A putter head as defined in claim 1, wherein said body section includes a rigid club shaft support integral at one end with said body section adjacent one end of said recess, and projecting at the opposite end thereof above said body section and having therein an opening for receiving one end of a club shaft.

8. A putter head as defined in claim 1, wherein said one side of said body section comprises a rigid side wall having on one side thereof said external, planar face, and on the opposite side thereof an inner surface extending parallel to said external planar face and confronting on said recess, and said support has thereon a planar face disposed in spaced, confronting relation to said inner surface of said side wall.

9. A putter head as defined in claim 8, wherein a portion of said support and said sighting line at one end thereof overlie the top of said side wall.

10. A putter head as defined in claim 8, wherein said support has thereon a planar bottom surface disposed in coplanar sliding engagement with a registering planar surface formed on said body section at the bottom of said recess.

11. A putter head as defined in claim 1 wherein the sighting line support does not extend rearwardly beyond the body section.

* * * * *